US010399653B1

(12) United States Patent
Silta

(10) Patent No.: US 10,399,653 B1
(45) Date of Patent: Sep. 3, 2019

(54) JET SKI IMPELLER

(71) Applicant: Craig Silta, Trenary, MI (US)

(72) Inventor: Craig Silta, Trenary, MI (US)

( * ) Notice: Subject to any disclaimer, the term of this patent is extended or adjusted under 35 U.S.C. 154(b) by 0 days.

(21) Appl. No.: 15/711,645

(22) Filed: Sep. 21, 2017

(51) Int. Cl.
*B63H 11/08* (2006.01)
*B63B 35/73* (2006.01)

(52) U.S. Cl.
CPC ..... *B63H 11/08* (2013.01); *B63B 35/731* (2013.01); *B63H 2011/081* (2013.01)

(58) Field of Classification Search
CPC . B63H 5/00; B63H 5/14; B63H 11/00; B63H 11/08; B63H 20/00; B63H 1/00; B63H 1/16; B63H 23/00; B63H 23/30; B63H 23/34
USPC ..... 440/38, 46
See application file for complete search history.

(56) References Cited

U.S. PATENT DOCUMENTS 2,965,065 A 12/1960 Tinker
3,367,116 A * 2/1968 Stallman ..... B63H 11/08 440/46
3,389,558 A 6/1968 Hall
3,677,660 A 7/1972 Fujio et al.
4,106,425 A 8/1978 Gruber
5,722,866 A 3/1998 Lennart
5,759,074 A * 6/1998 Jones ..... B63H 11/08 440/38
6,398,600 B1 6/2002 Lawson
7,950,974 B2 5/2011 Yuting

OTHER PUBLICATIONS

Marine Service and Repair. Service description [online]. Copyright © 2018 Jackson Brown Motors Ltd. [Retrieved on Apr. 26, 2017]. <URL:http://www.jacksonbrown.co.nz/boat-servicing-repair-electrical-and-engines/>.

* cited by examiner

*Primary Examiner* — Lars A Olson
(74) *Attorney, Agent, or Firm* — Cramer Patent & Design, PLLC; Aaron R. Cramer

(57) ABSTRACT

A multi-vane impeller for use upon a watercraft such as a jet ski is provided having an integral hydraulic compression ring permanently affixed to the outer end portions of the vanes. The impeller eliminates a need for the wear ring portion which is commonly provided on most jet skis, and is expected to improve efficiency and reduce maintenance costs. It is envisioned that the impeller would be provided as standard or optional equipment on new jet ski designs as well as being made available as an add-on kit for existing jet skis.

18 Claims, 3 Drawing Sheets

JET SKI IMPELLER

RELATED APPLICATIONS

Not applicable.

FIELD OF THE INVENTION

The present invention relates generally to the field of impeller designs for a watercraft.

BACKGROUND OF THE INVENTION

Personal watercraft such as jet skis are a favorite with those who enjoy spending time around water. Their highly mobile nature coupled with their intimacy with the water make them extremely popular rental items as well. Much of their fun nature is derived from the fact that their propulsion is provided by a high-volume, high-pressure water pump which moves vast amounts of water thus allow for very fast and instantaneous speed. This water is drawn in through an inlet opening on the bottom of the watercraft and then passed through an impeller powered by the engine. As one would imagine, the impeller is subject to wear and replacement over time, often at considerable expense.

As such, manufacturers are on the lookout for new ideas and developments to help their product stand out from amongst the competition. Accordingly, there exists a need for a means by which the impeller used on jet skis can be modified to address the above-mentioned concerns.

The elimination of a wear ring in a conventional watercraft, such as a jet ski, results in reduced maintenance and a higher level of reliability. In a conventional impeller design, the wear ring is a stationary part of the impeller housing. As debris is deposited between the wear ring and the propeller, the wear ring eventually wears out resulting in a loss of efficiency and/or cavitation.

Various attempts have been made to solve problems found in the powered watercraft impeller design art. Among these are found in: U.S. Pat. No. 3,389,558 in the name of Hall; U.S. Pat. No. 3,677,660 in the name of Fujio et al.; and U.S. Pat. No. 5,722,866 in the name of Brandt. These prior art references are representative of cargo restraints.

The use of the impeller provides powered watercraft users increased performance and a higher level of reliability with regards to impeller performance in a manner which is quick, easy, and effective. None of the above inventions and patents, taken either singly or in combination, is seen to describe the invention as claimed. Thus, a need exists for a reliable impeller design, and to avoid the above-mentioned problems.

SUMMARY OF THE INVENTION

In view of the foregoing references, the inventor recognized the aforementioned inherent problems and observed that there is a need to provide such an improved impeller for removable attachment to a drive shaft of a watercraft such as a jet ski. Such an improved impeller eliminates the need for separate consumable wear ring and provides for such an impeller to have a compression ring bonded to the vanes of the impeller. The bonding can be permanent and can either be during a machine welding or bonding process or the compression ring can be an integral part of the impeller.

An aspect of the invention is to provide such an impeller including a hub assembly that is generally cylindrical in nature having a first side, a second side, and a sidewall. A plurality of vanes, each having a proximal end located on the hub assembly sidewall and each extending outwardly from a common side thereof is disposed radially thereabout, and the compression ring bonded to a distal end of each vane and disposed concentrically to the hub assembly.

Another aspect of the invention is to provide such a hub assembly further including an upwardly extending cylindrical straight section, a tapered section extending away from the straight section, an attachment aperture formed along a vertical centerline of the hub assembly, and a plurality of equally-spaced inner splines located on an inner surface of the attachment aperture and coextensive with a length thereof. The plurality of splines is configured to engage a corresponding splined portion of the drive shaft of the watercraft.

A further aspect of the invention is to provide such a plurality of vanes where each vane protrudes parallel to a declining plane such that each distal end is bonded along a common circumscribed line of an inner surface of the compression ring. In certain embodiments, there are a total of three (3) vanes, each being identical. In other certain embodiments, the vanes are equidistantly spaced about the common side of the hub assembly. In other embodiments, the plurality of vanes is integrally formed with the hub assembly.

Yet another aspect of the invention is to provide such a compression ring being fashioned as an open-ended cylinder-shaped structure having a vertically upward divergent shape. In this instance, an upper perimeter edge has a slightly greater diameter than a lower perimeter edge.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
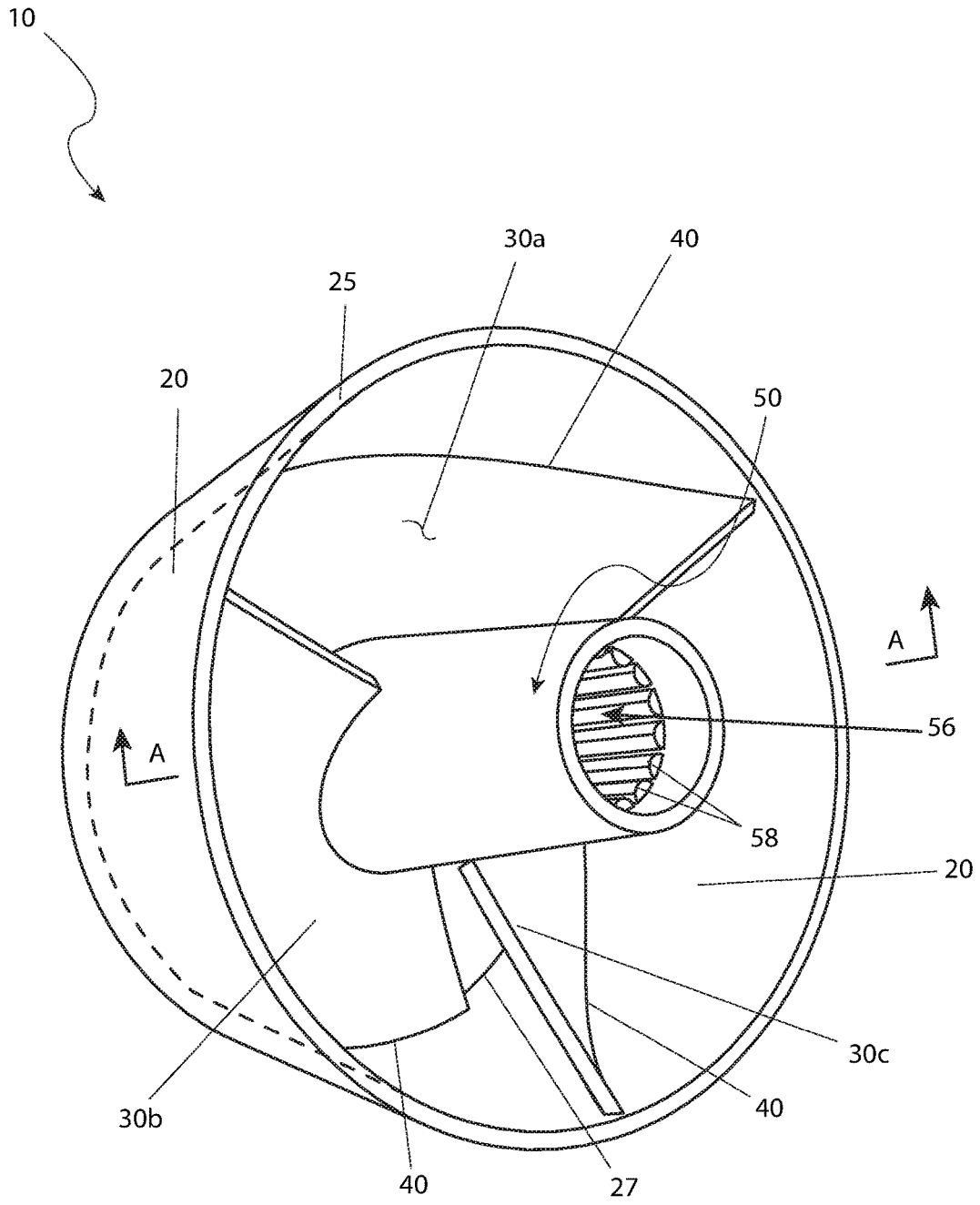
FIG. 1 is a perspective view of a jet ski impeller 10, according to a preferred embodiment of the present invention.

10 jet ski impeller
20 compression ring
23 inner surface
25 upper edge
27 lower edge
30*a* first vane
30*b* second vane
30*c* third vane
40 vane attachment
50 hub assembly
52 straight section
54 tapered section
56 attachment aperture
58 shaft spline
100 existing jet ski
110 motor
120 drive shaft

125 impeller housing
130 steering nozzle
140 operator

DETAILED DESCRIPTION OF THE PREFERRED EMBODIMENT

Figure 2:
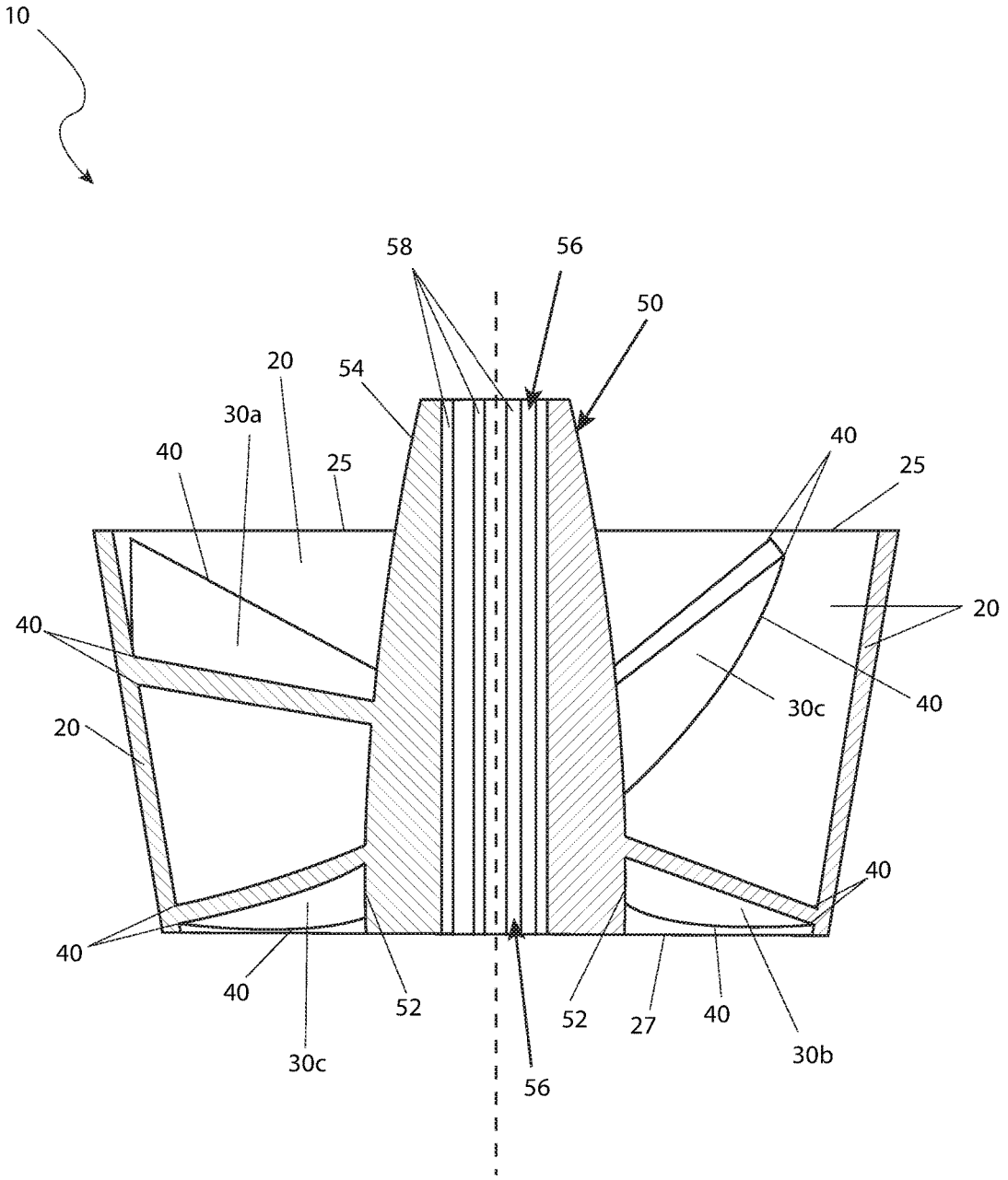
FIG. 2 is a sectional view of the jet ski impeller 10, according to a preferred embodiment of the present invention; and, FIG. 3 is an environmental view of the jet ski impeller 10 depicting an in-use state within a jet ski 100, according to a preferred embodiment of the present invention.
Figure 3:
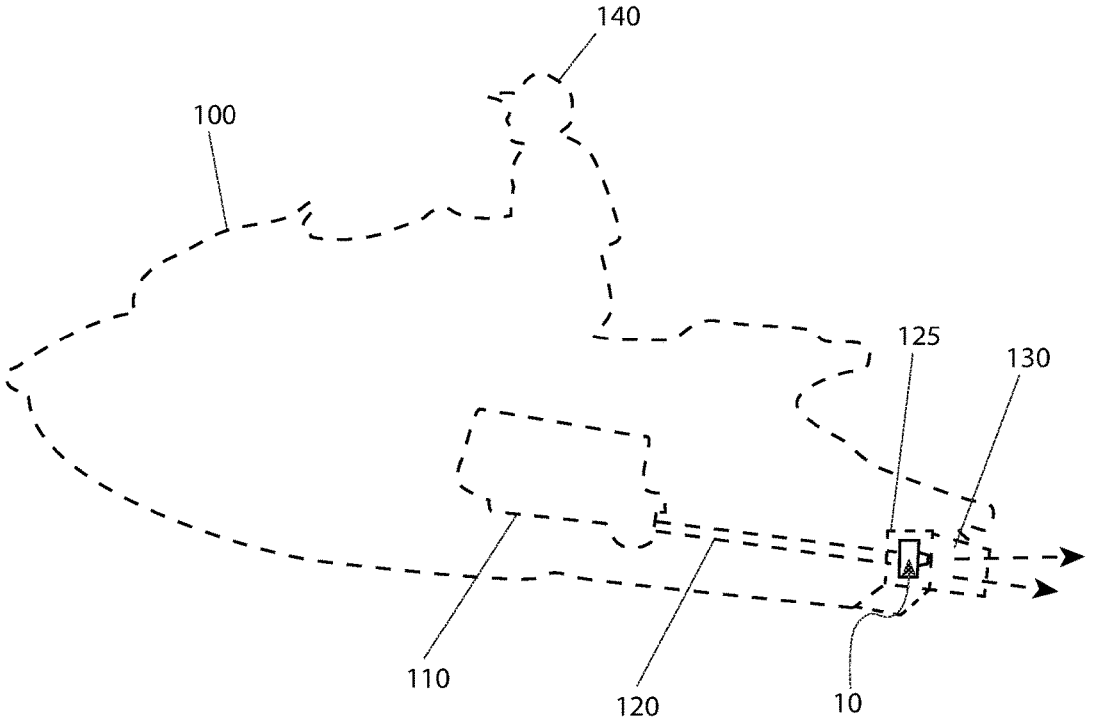

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a jet ski impeller (herein described as the "device") 10, which provides a multi-vane impeller having an integrated hydraulic compression ring 20 being permanently affixed to outer end portions of each vane 30*a*, 30*b*, 30*c*. The device 10 eliminates a need for, as well as the eventual replacement of, a conventional wear ring portion commonly used in conjunction with current impeller designs. It is envisioned that the device 10 would be provided as standard or optional equipment on new jet ski designs as well as being made available as an add-on kit or repair kit for existing jet skis 100.

Referring now to FIGS. 1 and 2, perspective and sectional views of the device, according to a preferred embodiment of the present invention, are disclosed. The embodiment of the device 10 illustrated here includes a compression ring 20, three (3) impeller vanes 30*a*, 30*b*, 30*c*, and a hub assembly 50. The device 10 provides a single-part construction being preferably made of a high quality stainless steel alloy or equivalent material. The device 10 further includes identical first vane 30*a*, second vane 30*b*, and third vane 30*c* portions being arranged in an equally-spaced radial pattern around the centrally located hub assembly 50. In the embodiment shown here, the proximal end portions of each vane 30*a*, 30*b*, 30*c* are integral to, and extend outwardly from, the side surfaces of the hub assembly 50. Each vane 30*a*, 30*b*, 30*c* extends from an intermediate side portion of the hub assembly 50 and protrudes parallel to a declining plane, whereupon a distal end portion of the vane 30*a*, 30*b*, 30*b* contacts and is permanently affixed along a common circumscribed intersecting line of an inner surface 23 of the compression ring 20. Attachment of the distal end of the vanes 30*a*, 30*b*, 30*b* to the compression ring 20 are preferably affixed using a welding process or equivalent metal joining method. However, it is envisioned that the compression ring 20, the vanes 30*a*, 30*b*, 30*c*, and the hub assembly 50 could also be machined as a single piece out of a solid metal billet with equal benefit, and as such should not be interpreted as a limiting factor of the device 10.

The compression ring 20 shown in FIG. 2 provides an open-ended cylinder-shaped structure having a vertically upward divergent shape which results in a circular upper edge 25 having a slightly greater diameter than the subjacent circular lower edge 27.

The hub assembly 50, as seen in FIG. 2, provides a metal cylindrical form being manufactured using casting or machining methods and being positioned along a vertical centerline of the device 10, being concentric with relation to the previously described compression ring 20. The hub assembly 50 includes an upwardly extending cylindrical straight section 52 which transitions to a superjacent hydrodynamic tapered section 54. A cylindrical attachment aperture 56 is formed along a vertical centerline of the hub assembly 50 completely through the hub assembly 50. The attachment aperture 56 is shown here having a plurality of equally-spaced rectangular inner splines 58. The splines 58 are to be of a suitable size and spacing to engage a corresponding splined drive shaft portion 120 of an existing jet ski 100; however, it is understood that different models of the device 10 would be available having various types of attachment apertures 56 being configured with various machine threads, tapered bores, or the like, in different sizes, for attachment to other correspondingly prepared jet ski drive shafts 120, and as such should not be interpreted as a limiting factor of the device 10.

The direct attachment of the vanes 30*a*, 30*b*, 30*c* to the compression ring 20 provides for nearly one-hundred (100%) percent compression of water being pumped through the device 10, thus improving overall performance of the existing jet ski 100.

The elimination of a conventional wear ring results in reduced maintenance and a higher level of reliability. In a conventional impeller design, the wear ring is a stationary part of the impeller housing. As debris is deposited between the wear ring and the propeller, the wear ring eventually wears out resulting in a loss of efficiency and/or cavitation.

It is understood that other embodiments of the device 10 may be configured for use in existing boat motors or new boat motor designs as well, without deviating from the teachings of the invention 10.

Referring now to FIG. 3, an environmental view of the device 10 depicting an in-use state within a jet ski 100, according to a preferred embodiment of the present invention, is disclosed. The device 10 is shown here in the context of an existing jet ski 100. The device 10 is attached to a drive shaft portion 120 of the jet ski 100 via the previously described hub assembly 50, and is positioned within an existing stationary impeller housing 125. In use, a torque is applied to the drive shaft 120 by the jet skis motor 110 resulting in a rearward flow of water which exits the device 10 and flows through a steering nozzle 130 which is manipulated by an operator 140 to direct the jet ski 100.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 3.

The method of installing and utilizing the device 10 upon an existing jet ski 100 may be achieved by performing the following steps: procuring a model of the device 10 being particularly suited to a specific existing jet ski 100 and/or drive shaft 120 onto which the device 10 is to be installed; removing existing impeller and wear ring portions from the existing jet ski 100; installing the device 10 upon the existing jet ski 100 by inserting the drive shaft 120 through the attachment aperture portion 56 of the device 10; securing the device 10 to the drive shaft 120 using original or supplied securing hardware; replacing all other components of the existing jet ski 100 which may have had to be temporarily removed during the installation of the device 10; allowing an operator 140 to activate and operate the existing jet ski 100 in a normal manner; and, benefiting from improved performance and reduced maintenance of a jet ski 100, afforded a user 140 of the present invention 10.

It is understood that alternate embodiments of the present invention 10 would be available being configured for retrofitting to other makes and models of jet skis 100, as well as models being configured for installation upon various makes and models of boat motors.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An impeller, comprising:

a generally cylindrical hub assembly having a first side, a second side, and a sidewall, said generally cylindrical hub assembly provides a metal cylindrical form manufactured using casting or machining methods and positioned along a vertical centerline of said impeller;

a plurality of vanes, each having a proximal end located on said hub assembly sidewall and each extending outwardly from said hub assembly towards a common side thereof and disposed radially thereabout; and, a compression ring bonded to a distal end of each vane, said compression ring disposed concentrically to said hub assembly, said hub assembly includes an upwardly extending cylindrical straight section which transitions to a superjacent hydrodynamic tapered section;

wherein said impeller replacing an existing impeller and an existing wear ring on a drive shaft of a watercraft;

wherein said hub assembly further comprises:

an upwardly extending cylindrical straight section;

a tapered section extending away from said straight section;

an attachment aperture formed along a vertical centerline of said hub assembly;

a plurality of equally-spaced inner splines located on an inner surface of said attachment aperture and coextensive with a length thereof;

wherein said plurality of splines are configured to engage a corresponding splined portion of said drive shaft of said watercraft.

2. The impeller of claim 1, wherein said plurality of vanes are identical.

3. The impeller of claim 2, wherein each vane protrudes parallel to a declining plane.

4. The impeller of claim 3, wherein said distal end of each vane is bonded along a common circumscribed line of an inner surface of said compression ring.

5. The impeller of claim 4, further comprising three vanes.

6. The impeller of claim 5, wherein said vanes are equidistantly spaced about said common side of said hub assembly.

7. The impeller of claim 1, wherein said plurality of vanes are integral with said hub assembly.

8. The impeller of claim 7, wherein said distal end of each vane is bonded along a common circumscribed line of an inner surface of said compression ring.

9. The impeller of claim 8, further comprising three vanes.

10. The impeller of claim 9, wherein said vanes are equidistantly spaced about said common side of said hub assembly.

11. The impeller of claim 1, wherein said compression ring comprises an open-ended cylinder-shaped structure having a vertically upward divergent shape;

wherein an upper perimeter edge has a slightly greater diameter than a lower perimeter edge.

12. An impeller, comprising:

a generally cylindrical hub assembly having a first side, a second side, and a sidewall, said generally cylindrical hub assembly provides a metal cylindrical form manufactured using casting or machining methods and positioned along a vertical centerline of said impeller;

a plurality of vanes, each having a proximal end located on said hub assembly sidewall and each extending outwardly from said hub assembly towards a common side thereof and disposed radially thereabout; and, a compression ring bonded to a distal end of each vane, said compression ring disposed concentrically to said hub assembly;

wherein said hub assembly, said plurality of vanes, and said compression ring are a unitary fabrication, said hub assembly includes an upwardly extending cylindrical straight section which transitions to a superjacent hydrodynamic tapered section;

wherein said impeller is configured to replace an existing impeller and an existing wear ring on a drive shaft of a watercraft, wherein said hub assembly further comprises:

an upwardly extending cylindrical straight section;

a tapered section extending away from said straight section;

an attachment aperture formed along a vertical centerline of said hub assembly;

a plurality of equally-spaced inner splines located on an inner surface of said attachment aperture and coextensive with a length thereof;

wherein said plurality of splines are configured to engage a corresponding splined portion of said drive shaft of said watercraft.

13. The impeller of claim 12, wherein said plurality of vanes are identical.

14. The impeller of claim 13, wherein each vane protrudes parallel to a declining plane.

15. The impeller of claim 14, wherein said distal end of each vane is bonded along a common circumscribed line of an inner surface of said compression ring.

16. The impeller of claim 15, further comprising three vanes.

17. The impeller of claim 16, wherein said vanes are equidistantly spaced about said common side of said hub assembly.

18. The impeller of claim 11, wherein said compression ring comprises an open-ended cylinder-shaped structure having a vertically upward divergent shape;

wherein an upper perimeter edge has a slightly greater diameter than a lower perimeter edge.

* * * * *